United States Patent [19]

Nass

[11] Patent Number: 4,999,876

[45] Date of Patent: Mar. 19, 1991

[54] DOOR JAMB MOUNTABLE HINGE

[76] Inventor: Richard Nass, 4545 Pratt Rd., Hadley, Mich. 48440

[21] Appl. No.: 465,636

[22] Filed: Jan. 22, 1990

Related U.S. Application Data

[63] Continuation of Ser. No. 309,330, Feb. 10, 1989, abandoned.

[51] Int. Cl.[5] ..... E05D 7/04; E05D 7/06

[52] U.S. Cl. ..... 16/236; 16/239

[58] Field of Search ..... 16/235, 236, 237, 238, 16/239, 249

[56] References Cited

U.S. PATENT DOCUMENTS

| | | | |
|---|---|---|---|
| 2,882,962 | 4/1959 | Hollansworth | 160/118 |
| 3,002,218 | 10/1961 | Hollansworth | 16/151 |
| 3,206,794 | 9/1965 | Johnson, Jr. | 16/237 |
| 3,251,089 | 5/1989 | Fergison | 16/151 |
| 3,646,635 | 3/1972 | Stermac | 16/239 |

FOREIGN PATENT DOCUMENTS

| | | | |
|---|---|---|---|
| 2455157 | 12/1980 | France | 16/237 |

*Primary Examiner*—Richard K. Seidel
*Assistant Examiner*—Carmine Cuda
*Attorney, Agent, or Firm*—Owen E. Perry

[57] ABSTRACT

A door jamb mountable hinge (14) for supporting folding doors (10). The assembly (14) comprises an L-shaped bracket (16) having a mountable portion (18) and a support portion (20). The mountable portion (18) is attached to the door jamb (12) and the support portion (20) supports the adjustable hinge arm support (30). The hinge support arm (30) supports a pivotally mounted folding door (10) which allows the bracket (16) to be mounted behind the plane of the closed door (10) and out of view. The hinge support arm (30) is threadily secured in position via a bolt (38).

4 Claims, 1 Drawing Sheet

DOOR JAMB MOUNTABLE HINGE

This application is a continuation-in-part, continuation of application Ser. No. 309,330, filed Feb. 10, 1989, now abandoned.

TECHNICAL FIELD

This invention relates to hinges for doors. More particularly, this invention relates to door jamb mountable hinges used to hingedly support multiple doors.

BACKGROUND ART

Hinges for folding doors have been designed to support a door securely and as tightly to the door jamb as possible This provides for a sturdy assembly and prevents unsightly gaps between the door jamb and the door. U.S. Pat. No. 3,251,089, issued May 17, 1966 to R. L. Fergison, discloses a folding door hinge wherein the hinge is mounted to the floor and the door jamb. This allows the door to be close to the door jamb by using the door jamb as additional support. U.S. Pat. No. 2,882,962, issued Apr. 21, 1959 and U.S. Pat. No. 3,002,218 issued Oct. 3, 1961, both to Hollansworth disclose folding door hinges. In U.S. Pat. No. 2,882,962, a door hinge for foldable doors is disclosed including pivot pins which are spring loaded by springs mounted in a position to extend perpendicular to the door jamb within the plane of the closed door. Such spring loading enables the door panel to be positioned closer to the door jamb when the door panels are in the closed position and while providing translational movement of the pins when the door panels are opened so the corners of the door panel may rotate about pivot pins without locking against the door jamb In U.S. Pat. No. 3,002,218, door panels are positioned contiguous with the door jamb by movable pins loaded by coil springs as described in the previous patent. This patent also discloses a means to align the top door panel closer to the top track by providing a lateral slot in which the pin may move during installation.

These hinges, however, can disfigure the door jamb and/or the floor. In other words, these prior assemblies do not enhance the aesthetic characteristics of folding doors because no matter how close the door panels are to the door jamb, floor and header, the hinge is always visible. The subject invention overcomes this deficiency by providing a structure which allows the hinge to be placed behind the plane created by the closed door panels and, therefore, out of sight. The subject invention is also door jamb mountable which leaves the floor free from unsightly structure.

SUMMARY OF THE INVENTION AND ADVANTAGES

A hinge assembly for supporting a door adjacent a door jamb comprising a bracket having a mounting portion for attachment to the door jamb and a support portion which extends therefrom. A hinge extension supports a door for rotation about a hinge axis extending substantially parallel to the door jamb. This hinge is characterized by an adjustable connection which interconnects the support portion of the bracket and the hinge extension for fixedly positioning the hinge axis in any one of various positions spaced laterally from the mounting portion of the bracket.

Accordingly, the hinge assembly allows folding doors to be mounted close to the door jamb, thus diminishing the gap between the door jamb and the folding door. In addition, the hinge extension allows the hinge to be removed from view by mounting the hinge behind the plane of the closed door.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
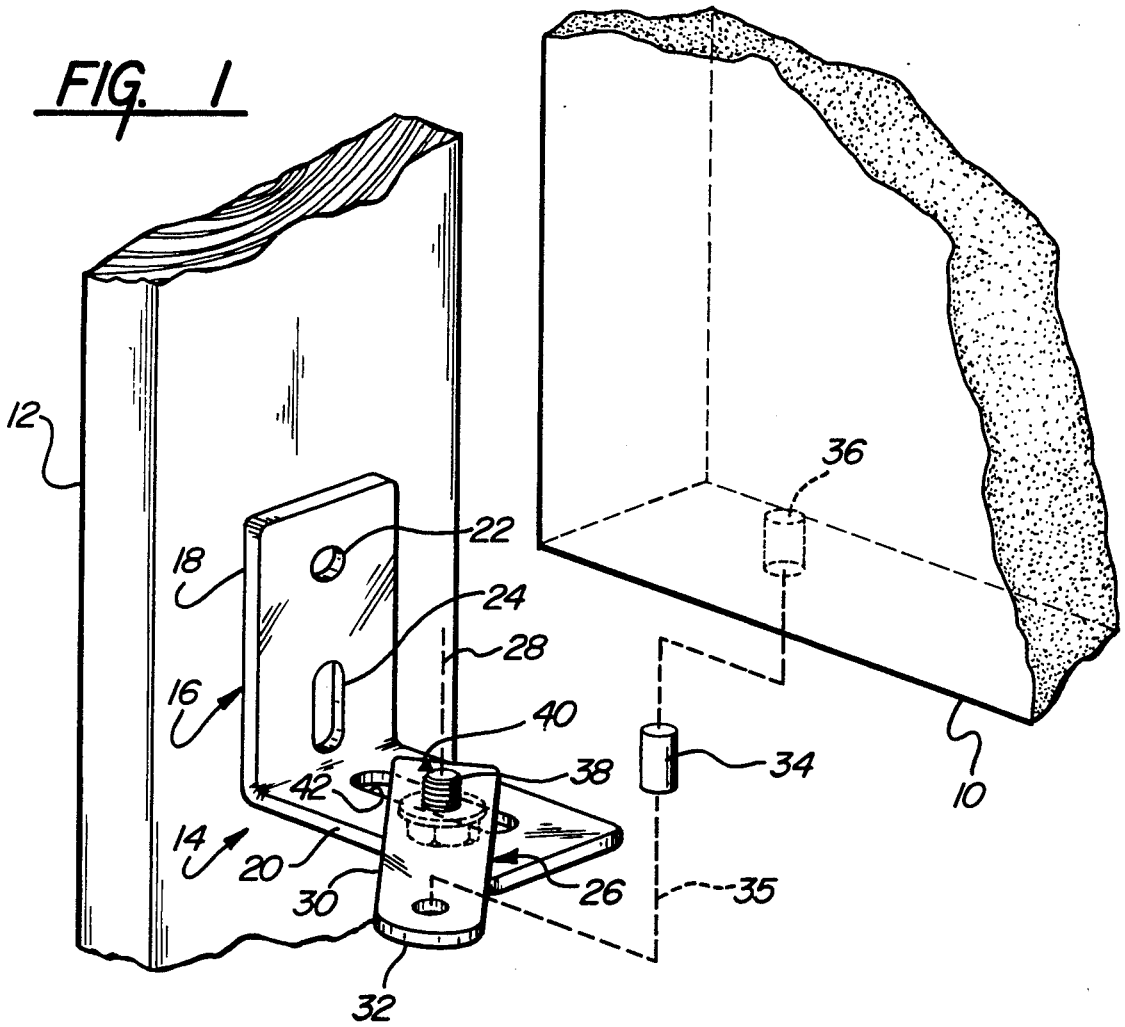
FIG. 1 is a fragmentary perspective view of the subject invention.

A hinge assembly for supporting a door 10 adjacent a door jamb 12 is generally shown at 14. The hinge assembly 14 comprises bracket means, generally indicated at 16. The bracket means 16 consists of an integral bracket 16 with a mounting portion 18 for attachment to the door jamb 12 and a support portion 20 extending substantially perpendicularly therefrom. That is, the mounting portion 18 includes a plurality of mounting holes 22,24 for receiving a fastener such as a screw (not shown). The mounting portion 18 is mounted flush with the door jamb 12 and is secured thereto by the fasteners (not shown) through the mounting holes 22,24. One of the holes, preferably the lower hole 24, is elongated to permit vertical adjustment of the mounting portion 18. The support portion 20 extends perpendicularly outwardly from the mounting portion 18 away from the door jamb 12. Preferably, the support portion 20 and the mounting portion 18 comprise one L-shaped piece.

The assembly 14 further includes hinge means, generally indicated at 26. The hinge means 26 supports a door 10 for rotation about a hinge axis 35 extending substantially parallel to the door jamb 12 as will be described in greater detail subsequently. The hinge means 26 includes a hinge support arm 30. The hinge support arm 30 comprises a generally flat plate 30. The support arm 30 has an opening therethrough for receiving a fastener 22 adapted for pivotally connecting the support arm 30 with the support portion 20 of the bracket 16. The hinge support arm 30 extends to a rounded distal end 32 spaced away from the support portion 20. The distal end 32 has hinge pin 34 extending upwardly from the distal end 32. The hinge pin 34 is for mounting the support arm 30 with a door 10. That is, the hinge pin 34 is received by a complimentary shaped door mount or recess 36 in the bottom of the door 10.

The hinge means 26 further includes adjustable connection means, generally indicated at 40. The adjustable connection means 40 interconnects the support portion 20 of the bracket 16 and the hinge support arm 30 for fixedly positioning the hinge axis 35 in any one of several various predetermined positions laterally from the mounting position of the bracket 16.

Figure 2:
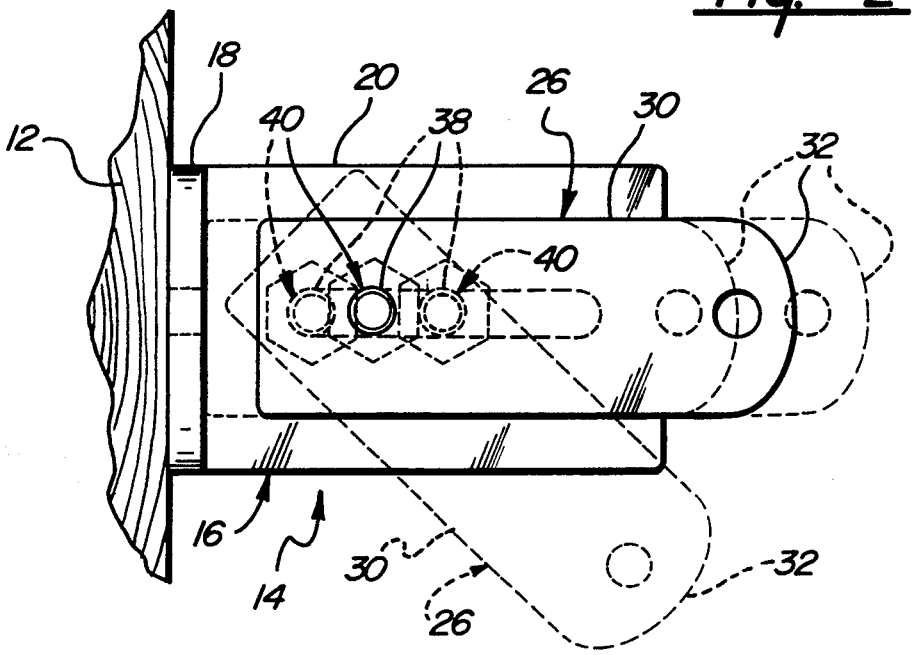
FIG. 2 is plan view of the subject invention.

More specifically, the adjustable connection means 40 includes an elongated slot 24. This elongated slot 42 houses a clamping fastener 38, typically a bolt 38, which extends from the support arm 20 through the elongated slot 42. The opening preferably has female threads for receiving the male threaded fastener 38. The bolt 38 possesses two degrees of freedom within the elongated slot; these being rotational and slideable freedoms. In other words, the bolt 38 is threadably received by and retained in threads in the support arm 30 and is not threadily attached in any portion of the elongated slot 42. This allows the hinge support arm 30 to be moved both longitudinally and rotationally with respect to the support portion 20 of the bracket 16. As shown in FIG. 2, hinge means 26, in phantom, shows the various positions due to the two degrees of freedom. When the hinge support arm 30 is in the predetermined position it is fixedly secured to prevent movement of the hinge support arm 30 relative to the support portion 20. This is done by tightening the bolt 38 into the threaded hole (not shown) in the hinge support arm 30. The longitudinal axis of the bolt 38 defines the support arm axis 28 of the support arm 30. The longitudinal axis of the hinge pin 34 defines the door axis 35.

When tightened, the hinge support arm 30 frictionally engages the support portion 20 and prevents relative movement therebetween. The hinge support arm 30 includes a hinge pin 34 extending upwardly therefrom which hingedly supports and aligns the door pin housing 36.

In operation, the hinge assembly 14 is installed as follows. First, the mounting portion 18 is positioned flush with the door joint 12 at the desired height. A first fastener is placed through the elongated opening 24 and partially tightened. The mounting portion is then slid vertically to its final desired height relative to the door jamb 12. The fastener is then fully tightened, and a second fastener is inserted through the hole 22 on the mounting portion 18. With this connection made, the support portion 20 extends substantially perpendicular to the door jamb 12. The hinge support arm 30 is then rotated and moved longitudinally relative to the support portion 20 to its final desired position. The bolt 38 is then tightened into the female threaded hole in the support arm 30. This frictionally locks the hinge support arm 30 to the support portion 20 and prevents relative movement therebetween. The hinge pin 34 on the distal end of the support arm 30 extends upwardly. The door 10 having the mount 36 is then positioned over the hinge support arm 30 such that the door mount 36 receives the hinge pin 34. In this manner, the door 10 is free to rotate about the hinge pin 34 and forwardly of the bracket 16. This permits the door 10 to be positioned in close proximity to the door jamb 12 and place the bracket 16 behind the door 10 and out of view.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A hinge assembly (14) for supporting a door (10) adjacent a door jamb (12), said assembly comprising:

bracket means (16) having a mounting portion (18) for attachment to the door jamb (12) and a planar support portion (20) extending therefrom defining a plane with the periphery of said support portion (20) in said plane, and hinge means (26) for supporting a door (10) for rotation about a door hinge axis (35) extending substantially parallel to the door jamb (12), and disposed upon the top of said support portion (20);

said hinge means (26) including a hinge support arm (30) and adjustable connection means (40) interconnecting said support portion (20) of said bracket means (16) and said hinge support arm (30) for fixedly positioning said door hinge axis (35) in any one of various predetermined positions spaced laterally from said mounting portion of said bracket means (16);

said assembly characterized by said hinge support arm (30) including a threaded aperture, said adjustable connection means (40) consisting of a single elongated slot (42) and a single clamping fastener (38) extending through and in threaded engagement with said aperture of said hinge support arm (30) and through said elongated slot (42), said clamping fastener (38) being rotatable in and slideable along said elongated slot (42) in a loose condition to move said hinge support arm (30) between predetermined positions and being fixed to prevent movement of said hinge support arm (30) relative to said support portion (20) when in a clamped condition the longitudinal axis of said clamping fastener defines a support arm pivot axis (28) which is laterally spaced from said door hinge axis (35).

2. An assembly as set forth in claim 1 further characterized by said bracket means (16) comprising an L-shaped member (16) with mounting holes (22,24) in the mounting portion (18) thereof and said elongated slot (42) in the support portion (20) thereof.

3. An assembly as set forth in claim 2 further characterized by said hinge means (26) comprising said hinge support arm (30) supporting said clamping fastener (38) and extending to a rounded distal end (32).

4. An assembly as set forth in claim 3 further characterized by said hinge means (26) comprising a hinge pin (34) supported adjacent said distal end (32) of said hinge support arm (30).

* * * * *